United States Patent [19]

Rosenwinkel et al.

[11] 4,324,063

[45] Apr. 13, 1982

[54] TOY MOTOR VEHICLE

[75] Inventors: Donald A. Rosenwinkel, Tinely Park; Harry Disko, South Barrington, both of Ill.

[73] Assignee: Marvin Glass & Associates, Chicago, Ill.

[21] Appl. No.: 192,867

[22] Filed: Oct. 1, 1980

[51] Int. Cl.[3] ..... A63H 17/00; A63H 29/16

[52] U.S. Cl. ..... 46/44; 46/209

[58] Field of Search ..... 46/44, 209, 56

[56] References Cited

U.S. PATENT DOCUMENTS

| | | | |
|---|---|---|---|
| 771,649 | 10/1904 | Lane | 46/56 X |
| 1,388,232 | 8/1921 | Zsarnay | 46/56 X |
| 1,788,752 | 1/1931 | Thornton | 46/56 X |
| 2,608,027 | 8/1952 | Perker et al. | 46/209 X |
| 2,903,817 | 9/1959 | McLain et al. | 46/44 |
| 2,987,847 | 6/1961 | Jones | 46/56 X |
| 3,613,303 | 11/1968 | Allen | 46/44 X |
| 3,789,540 | 2/1974 | Convertine et al. | 46/209 X |

*Primary Examiner*—F. Barry Shay

*Attorney, Agent, or Firm*—Mason, Kolehmainen, Rathburn & Wyss

[57] ABSTRACT

A self-propelled toy motor vehicle includes a wheel for supporting the vehicle body to roll over a playing surface. The wheel includes a plurality of air vanes thereon for causing the wheel to rotate in response to a stream of air applied through a mouthpiece by a person blowing into the mouthpiece. The wheel is relatively heavy and acts as a flywheel to store kinetic energy so that when the vehicle is placed on a playing surface after the wheel is spinning in rotation, the vehicle is self-propelled until the rotative energy of the flywheel is expended. The flywheel and vanes spin inside a wheel housing and this develops a whistling sound resembling a jet-powered vehicle.

9 Claims, 4 Drawing Figures

TOY MOTOR VEHICLE

BACKGROUND OF THE INVENTION

1. Field of the Invention

The present invention relates to a self-propelled toy vehicle having a flywheel therein which is driven to rotate and store energy by an air stream from a person applied through a mouthpiece.

2. Description of the Prior Art

Toy vehicles have been popular with young children and the like and have taken numerous forms through the years. U.S. Pat. No. 3,650,067 shows gyroscopic toy vehicles wherein a flywheel is driven to rotate and store kinetic energy for propelling the vehicle and mantaining gyroscopic stability. U.S. Pat. No. 3,192,664 discloses a toy vehicle having a flywheel therein driven to rotate by rotation of traction wheels on the vehicle separate therefrom. U.S. Pat. No. 3,621,607 discloses a self-propelled toy vehicle having a flywheel type traction wheel which is driven to rotate by a string wound upon an axle shaft supporting the flywheel. U.S. Pat. No. 3,789,540 discloses a compressed air propelled toy vehicle and launching system wherein a toy vehicle having an internal, air driven flywheel is placed on a launching structure while the flywheel is driven to rotate by a jet of air supplied from a pump on the launching mechanism. When the flywheel is rotating at a high enough kinetic energy level, the vehicle is ejected or released from the launching structure and is propelled by the energy stored in the flywheel as the vehicle moves over a playing surface.

OBJECTS OF THE INVENTION

It is an object of the present invention to provide a new and improved toy motor vehicle and more particularly, a toy motor vehicle of the type including a flywheel motor therein used for storage of kinetic energy to provide self-propulsion for the vehicle when released on a playing surface.

Still another object of the present invention is to provide a new and improved toy motor vehicle of the character described wherein a flywheel is energized to rotate by a stream of air received from a mouthpiece provided on the vehicle body.

Still another object of the present invention is to provide a new and improved toy motor vehicle wherein a mouthpiece is formed on the body so that a person may blow into the same to rotate a flywheel mounted internally of the vehicle for use in storing kinetic energy to subsequently self-propel the vehicle over a playing surface when the vehicle is released thereon.

Yet another object of the present invention is to provide a new and improved toy motor vehicle of the character described which is neat and streamlined in appearance and which is relatively low in cost, simple of construction and useful to provide long hours of play for young children and the like.

Still another object of the present invention is to provide a new and improved toy motor vehicle of the character described which includes a traction wheel having a plurality of air vanes thereon designed to receive propelling energy from a mouthpiece carried on the body of the vehicle.

Still another object of the present invention is to provide a new and improved toy motor vehicle of the character described which uses the breath of a human being applied to the mouthpiece thereon for storing energy in a traction flywheel for propelling the vehicle over a playing surface.

Yet another object of the present invention is to provide a toy vehicle having a flywheel which produces a whistling sound when the flywheel is running.

BRIEF SUMMARY OF THE INVENTION

The foregoing and other objects of the present invention are accomplished in a new and improved self-propelled toy motor vehicle having wheel means for supporting a body of the vehicle for rolling movement on a playing surface. A plurality of air vanes are provided for rotating a traction wheel in response to a stream of air which is applied through a mouthpiece mounted on the body of the vehicle. The outer end of the mouthpiece is adapted to receive the breath of a person and the mouthpiece directs air inwardly into the path of the vanes for rotating the wheel which acts as a flywheel to store kinetic energy for propelling the vehicle over the playing surface when placed thereon. Preferably the vehicle is formed of molded plastic material and is of a streamlined design and appearance to please children and the like. Rotation of the vaned flywheel in a wheel chamber produces a whistling noise simulating the whine of a jet engine so that the toy vehicle closely represents a jet-powered automobile both in sound and in appearance.

BRIEF DESCRIPTION OF THE DRAWINGS

FIG. 4 is a transverse cross-sectional view taken substantially along lines 4—4 of FIG. 2.

DESCRIPTION OF A PREFERRED EMBODIMENT

Figure 1:
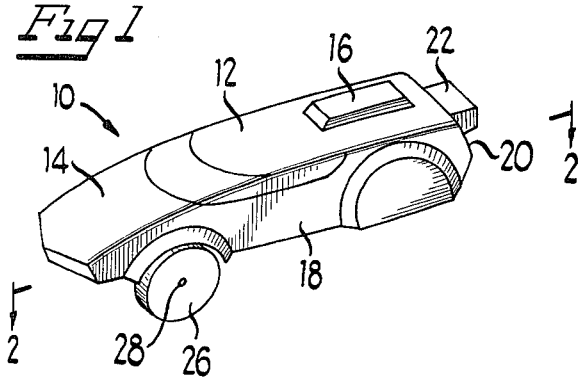
FIG. 1 is a perspective view of a new and improved toy motor vehicle constructed in accordance with the features of the present invention.

Referring now more particularly to the drawings, in FIG. 1 is illustrated a new and improved self-propelled toy motor vehicle of neat and streamlined appearance constructed in accordance with the features of the present invention. The vehicle is referred to generally by the reference numeral 10 and includes an elongated, streamlined, hollow body 12, preferably formed of molded plastic material and including a forwardly and downwardly sloping top wall 14 with a raised cockpit or passenger compartment 16 on the rear end portion of the wall. The vehicle body includes a pair of integral opposite side walls 18 and an integral rear wall 20. A longitudinally aligned mouthpiece 22 is mounted on the rear end wall and projects outwardly thereof, to provide an inlet surface to receive the lips and mouth of a person for blowing a breath of air forwardly into the hollow body of the vehicle.

The vehicle body also includes a lower or bottom wall 24 having notched out recesses **24*a* on opposite sides adjacent a front end portion in order to accommodate a pair of front wheels 26 mounted on a transverse axle 28. The axle is supported from a pair of integral, pillow block projections 24*b* formed on the bottom wall 24 adjacent the recesses 24*a*. At a rearward end portion of the vehicle directly below the passenger compartment or cockpit 16, there is provided a single, relatively heavy flywheel-like traction wheel 30 having a rubber traction tire 32** around the periphery in the center thereof for drivingly engaging the floor or other playing surface on which the vehicle is placed.

The traction wheel 30 is relatively heavy or dense and seves as a flywheel to store kinetic energy used for propelling the vehicle whenever the wheel is rotating at a relatively high speed and the vehicle is then placed and released on a playing surface. The flywheel 30 is mounted on a transversely exending axle 34 which spans between a pair of opposite side walls 36 of a wheel chamber 40. The chamber is centrally aligned on a longitudinally extending, vertical center plane of the vehicle body 12.

Preferably, the wheel chamber 40 is formed of molded plastic material and may be made separate from the vehicle body 12 in which it is mounted. The wheel chamber is generally cylindrical in shape and includes an integral, peripheral wall 38 joining the outer edges of the opposite sidewalls 36. The peripheral wall is provided with a central portion **38*a* of increased diameter with respect to flanking wall portions on opposite sides thereof. The large diameter central portion of the chamber wall 38*a* projects upwardly to key and seat in the raised passenger compartment or cockpit 16 formed on the atop wall 14 of the vehicle body. The bottom wall 24 of the vehicle body is formed with a large opening 25 in order to accommodate a lower portion of the wheel chamber 40 which projects downwardly through the bottom wall as best shown in FIGS. 3 and 4**.

The flywheel 30 is driven to rotate at a relatively high speed needed for storing kinetic energy by a pair of air turbine assemblies 50 mounted on opposite sides of the flywheel and carried on the common axle 34. Each turbine wheel includes a circular, inner side wall 52 adhesively or otherwise secured to the adjacent side face of the flywheel 30 and a plurality of generally radially extending air vanes 54 having curved outer end portions adapted to receive a propelling air stream from the internal or outlet end of the mouthpiece 22 as indicated by the arrows "A" in FIGS. 2 and 3. Each air turbine wheel also includes an outside circular disc or wall 56 having a circular center opening **56*a* for the passage of air between the interior of the body 12 and the turbine wheel as the wheel is rotated by impingement of a high velocity air stream from the mouthpiece 22 on the vanes 54. The center openings 56*a* of the respective turbine wheels are coaxially aligned with central openings 36*a* formed in the side walls 36 of the wheel chamber 40** and the chamber functions in a manner similar to the housing of a centrifugal fan but in a reverse direction.

Figure 3:
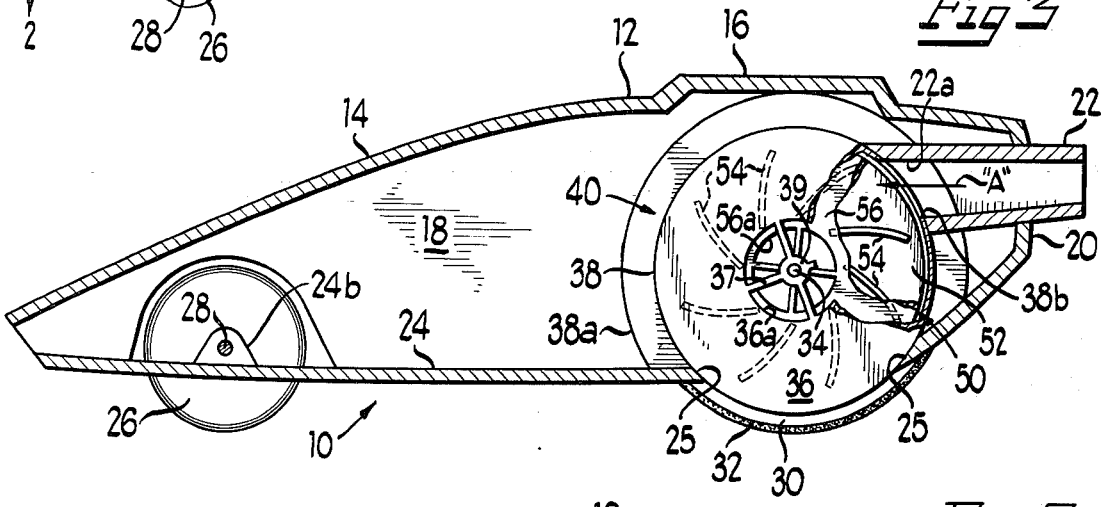
FIG. 3 is a longitudinal vertical cross-sectional view taken substantially along lines 3—3 of FIG. 2.
Figure 2:
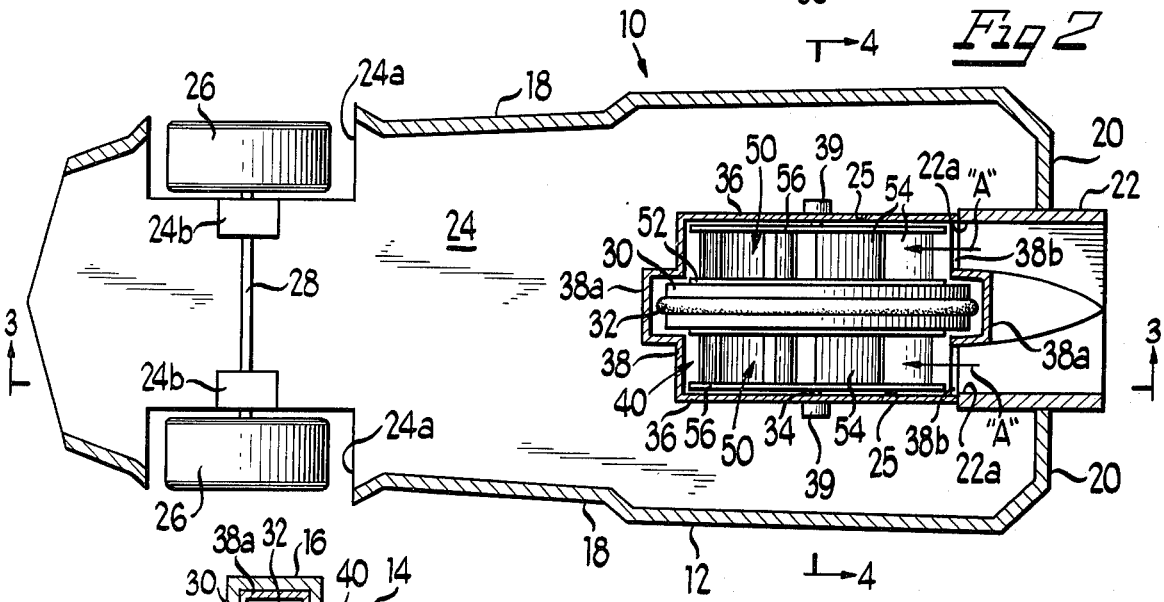
FIG. 2 is a longitudinal horizontal cross-sectional view taken substantially along lines 2—2 of FIG. 1.

As shown in FIGS. 2 and 3, each outer side wall 36 of the wheel housing is formed with a plurality of radial spokes 37 extending inwardly from the outer edge of the center opening **36*a* to support a central bearing hub 39 for supporting the wheel axle 34**.

The internal outlet end of the nozzle structure 22 is divided into a pair of spaced apart outlet openings **22*a* disposed on opposite sides of the large diameter central peripheral wall portion 38*a* of the wheel chamber 40 and these nozzle or mouthpiece outlets are each aligned with a rectangular opening 38*b* formed in the peripheral wall 38 of the air chamber on opposite sides of the central portion 38*a*. These inlet openings direct a high velocity air flow to impinge directly on the outer curved end portions of the radial turbine vanes 54 to cause the flywheel 30 to begin rotation when a person's breath is blown into the mouthpiece 22** from the outer end.

The air streams impinging on the air turbine wheel vanes or blades 54 cause the flywheel 30 to rotate or spin rapidly and the air may escape inwardly toward the axle 34 and then axially outwardly through the circular openings **36*a* and 56*a* into the interior of the hollow housing of the vehicle body 12. Some of the air blown into the wheel chamber 40 from the mouthiece of nozzle 22 may also escape to the atmosphere through a bottom opening or slot 38*c* formed in the peripheral wall 38 so that a portion of the wheel 30 and tire 32** is exposed for frictional contact with a playing surface.

When air is blown into the wheel chamber 40 from the mouthpiece 22, the turbine wheels 50 cause the flywheel 30 and traction tire 32 to begin to rotate rapidly and as this occurs, a whistling sound is generated which resembles the whine of a jet engine. When enough rotational speed and kinetic energy has been developed in the rotating flywheel 30, the toy vehicle 10 then may be placed on a playing surface and the traction tire 32 upon contact with the surface propels the vehicle in a direction longitudinally of the body 12 until the energy of the flywheel is exhausted.

The toy vehicle resembles in appearance a jet-powered automobile and the sound provided by the rotating flywheel 30 and the air turbines 50 thereon provide additional animation for a realistic toy. The toy vehicle 10 is relatively simple in construction, economical to produce on a mass production basis and can be used to provide many long hours of play for a young child.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A toy motor vehicle having wheel means fore and aft for supporting a body for rolling movement on a playing surface;

said aft wheel means including a wheel mounted for rotation on an axis transverse of said body and having a plurality of generally radial air vanes extending laterally outwardly on opposite sides for causing said wheel to rotate in response to a stream of air applied thereto;

a mouthpiece on an aft end portion of said body having a nozzle outlet in communication with said vanes on opposite sides of said wheel for directing a stream of air against said vanes for rotating said wheel when a person blows into said mouthpiece; and a wheel housing formed in said body enclosing said wheel on opposite sides of said vanes and having an inlet in communication with said outlet end of said mouthpiece above said axis causing said wheel to rotate in a forward direction, said mouthpiece including an inlet end portion projecting rearwardly outwardly of said aft end of said body, and having opposite sides aligned with opposite sides of said wheel housing, said wheel housing including an outlet opening on an underside of said body.

2. The toy motor vehicle of claim 1 wherein said wheel includes a relatively heavy center portion between sets of said air vanes on opposite sides thereof.

3. The toy motor vehicle of claim 2 wherein said mouthpiece includes internal divider means between said opposite sides of said housing for directing a stream of air against both sets of said vanes on opposite sides of said wheel.

4. The toy vehicle of claim 2 including a tire on said center portion of said wheel for engagement with said playing surface.

5. The toy vehicle of claim 4 wherein said fore wheel means includes a plurality of front wheels for supporting said body forwardly of said one wheel.

6. The toy vehicle of claim 5 wherein said front wheels are spaced on opposite sides of a longitudinal center line of said vehicle body and said one wheel is centered thereon.

7. The toy motor vehicle of claim 1 wherein said wheel housing includes a curved wall joined to peripheral edges of said opposite sides and at least one opening in said curved wall aligned with the outlet of said mouthpiece.

8. The toy motor of vehicle of claim 1 or 2 wherein said one wheel includes at least one pair of spaced apart circular members and said air vanes are spaced between said circular members around said transverse axis.

9. The toy motor vehicle of claim 8 including two pairs of said circular members, on opposite side of a heavy center portion of said one wheel engageable with said playing surface.

* * * * *